United States Patent [19]

McMahon et al.

[11] Patent Number: 4,909,017

[45] Date of Patent: Mar. 20, 1990

[54] RECLOSABLE BAG MATERIAL, METHOD AND APPARATUS

[75] Inventors: Michael J. McMahon, Palatine; Paul P. Spanier, Arlington Heights, both of Ill.

[73] Assignee: Minigrip, Inc., Orangeburg, N.Y.

[21] Appl. No.: 386,348

[22] Filed: Jul. 28, 1989

[51] Int. Cl.[4] ..... A44B 19/00; B31B 1/90; B65B 61/18; B65D 33/24

[52] U.S. Cl. ..... 53/410; 53/128; 53/412; 53/451; 53/551; 156/66; 383/63; 428/223; 493/213

[58] Field of Search ..... 53/128, 410, 412, 450, 53/451, 550, 551, 552; 156/66; 383/63; 428/223; 493/213, 214

[56] References Cited

U.S. PATENT DOCUMENTS

| | | | |
|---|---|---|---|
| 4,355,494 | 10/1982 | Tilman | 493/214 X |
| 4,601,694 | 7/1986 | Ausnit | 493/214 X |
| 4,617,683 | 10/1986 | Christoff | 53/551 X |
| 4,663,915 | 5/1987 | Van Erden et al. | 493/214 X |
| 4,666,536 | 5/1987 | Van Erden et al. | 428/223 X |
| 4,709,398 | 11/1987 | Ausnit | 383/63 |
| 4,709,533 | 12/1987 | Ausnit | 53/552 X |
| 4,790,126 | 12/1988 | Boeckmann | 53/552 X |
| 4,840,611 | 6/1989 | Van Erden et al. | 493/213 |

*Primary Examiner*—Robert L. Spruill
*Assistant Examiner*—Beth Bianca
*Attorney, Agent, or Firm*—Hill, Van Santen, Steadman & Simpson

[57] ABSTRACT

A new method of making a form fill bag having a reclosable fastener thereon and a mechanism therefor wherein a continuous length of film is advanced and joined first and second fastener profile strips are laid laterally onto the film of a length substantially equal to one-half of the film width, the film is advanced and formed into a tube with the side edges folded together and seamed, the first profile strip is attached to the surface of the film prior to forming it into the tube and the second opposed interlocked profile strip is attached to the inner surface of the film after it is formed into a tube, and a cross-seam is formed in the tube above the closure strip to form the bottom of the succeeding bag and a completed bag is cut from the film by cutting below the bottom seam and above the fastener strips.

29 Claims, 2 Drawing Sheets

RECLOSABLE BAG MATERIAL, METHOD AND APPARATUS

BACKGROUND OF THE INVENTION

The present invention relates to improvements in methods and apparatus for making bags by a form fill process wherein the bags have a reclosable fastener at the top. In the vertical form fill process, a length of plastic film is led downwardly over a tube with the lateral edges brought together and seamed to form a side seam, a cross-seam is created to form the bottom of a bag and contents are normally dropped in the bag through the tube about which the film is formed.

In the process of making reclosable bags that have a pressure closable fastener at the top, this fastener must be secured to the bag material in such a manner so that it is located at the top of the bag. The type of fastener to which the present invention relates is one which has interlockable rib and groove profiles. Where the bags are made of a thin film, these profiles are conveniently formed in strips of separate material. In this manner, the film of the bag can be made of a thin lightweight tough plastic having physical characteristics best suited for the bag. The fastener can be made of a different plastic having physical characteristics best suited for the fastener. The fastener is attached to the bag material by suitable means such as by adhesive or by heat sealing, and where both members are of plastic, the form of heat sealing attachment is particularly well suited for rapid operation and a secure joining between the fastener and the film of the bag material.

In a suitable manufacturing process wherein a series of bags are formed from a continuous supply of film, it is, of course, desirable that the machine can be operate at relatively high speed. Formation and filling of the bag involves drawing the film down over a vertical tube, forming the film into tubular shape, creating a side seam where the edges of the film are brought together and creating a bottom seam. The contents of the bag are then dropped through the tube and the tube drawn down whereupon the top is closed such as by pressing the rib and groove profile elements together to interlock them. The arrangement for providing the fastener strips on the inner surface of the bag wall is that the top of the bag creates difficulty in the high speed machine. One manner of attaching such fasteners has been to provide a continuous fastener strip across the film wherein the fastener strip has a plurality of ribs and grooves so that it can be folded on itself and the folded edge of the strip shifts so that the ribs enter the grooves. The difficulty with this arrangement is that this type of fastener strip often does not seal completely at the end and requires more plastic than the more simple rib and groove fastener. Other arrangements have been attempted which encounter difficulties and are not completely satisfactory.

FEATURES OF THE INVENTION

It is accordingly an object of the present invention to provide an improved method and apparatus for forming reclosable bags from a thin film wherein a fastener is provided at the top in a way that high speed operation can be achieved and the attachment of the fastener does not in any way impede the speed and facility of making and filling the bags by a form fill process.

A further object of the invention is to provide an improved method and apparatus for forming bags in a form fill process wherein a simple rib and groove profile fastener strip can be utilized for the top closure of the bag.

A further object of the invention is to provide an improved arrangement wherein the fastener can be attached to film for a film to be used in a form, fill and seal process in a reliable and expeditious manner.

In accordance with the invention, a continuous supply of bag film is fed forward to a form, fill and seal machine. Prior to entering the machine, a fastener strip is attached to the surface of the film. The fastener strips contain pre-joined interlocked rib and groove strips and only one of the strips is attached to the film with the other strip facing upwardly, or in other words, inwardly toward the interior of the bag to be formed. The combined fastener strip is preferably advanced laterally across the film during the time it stops for the cross-sealing and filling process of the form fill machine. Only one of the profile strips is secured to the surface of the film, that is, secured in one form at the center of the film being of only half of the film width. In another form, the strip can be attached at one side of the film extending halfway across.

The film is then advanced to the form fill machine and drawn down over the filling tube with the longitudinal side edge of the film brought together and seamed. The fastener strips, attached at one location on the inner surface of the film, slide over the form fill tube. The film is cross-sealed at the bottom of the bag and drawn downwardly, nd the cross-sealing mechanism used to then join the other wall of the bag to the other fastener strip. This will provide a fastener strip at the top of the bag wherein the strips are joined to opposing walls and interlock. Simultaneously, a cross-seal is formed above the strips and the tube is cut across below the cross-seal and above the fastener strips to remove a completed filled, closed bag.

Other objects, advantages and features will become more apparent with the teaching of the principles of the invention in connection with the disclosure of the preferred embodiments thereof in the specification, claims and drawings in which:

DESCRIPTION OF THE PREFERRED EMBODIMENTS

Figure 1:
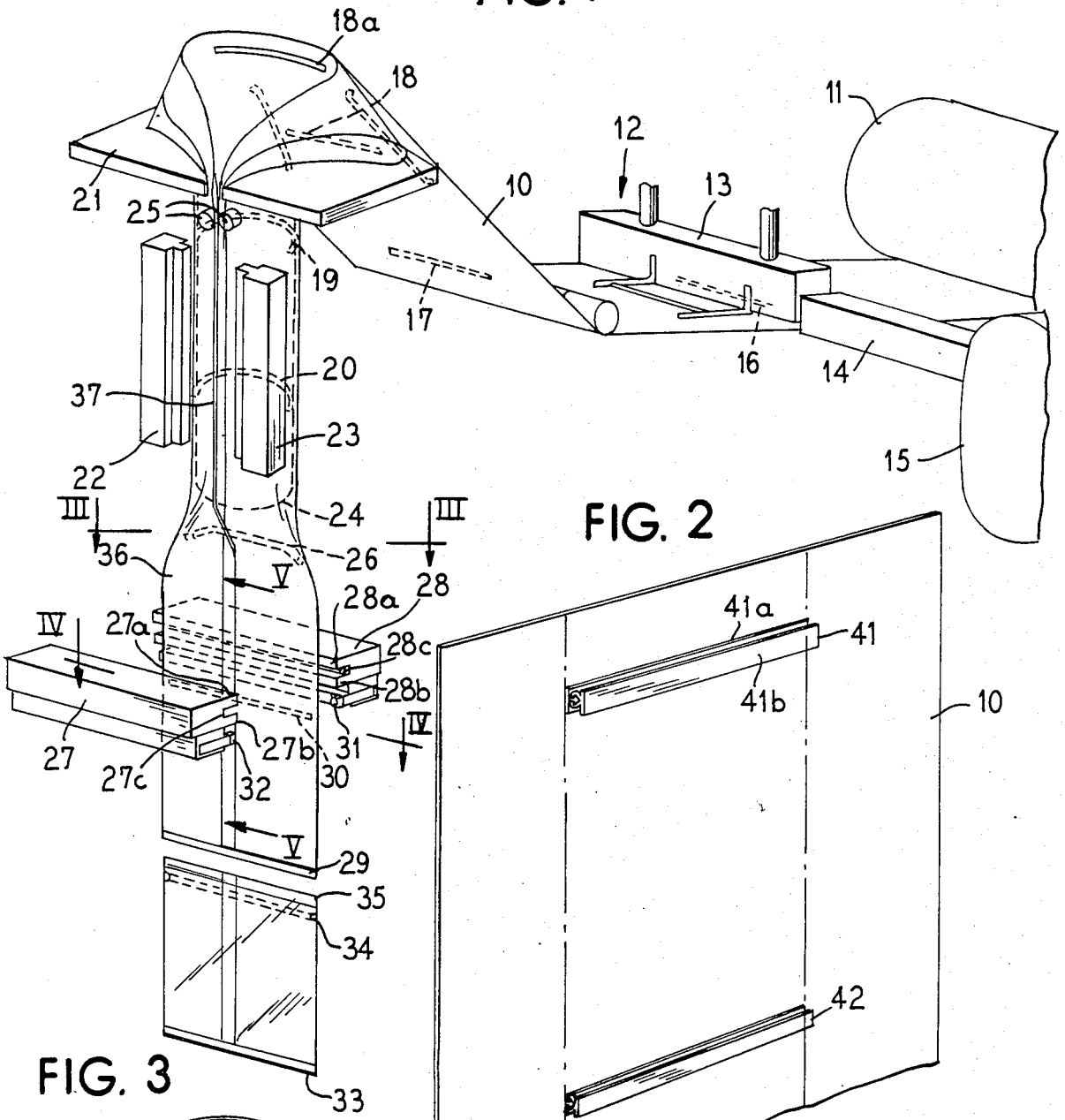
FIG. 1 is a perspective view, shown somewhat schematically, of a mechanism including form, fill and seal apparatus constructed and operating n accordance with the principles of the present invention.

As illustrated in FIG. 1, a continuous supply of thin bag making film 10 is fed forwardly of a supply roll 1. The film is drawn forwardly by a suitable mechanism which pulls the film downwardly to form it into a tube so that the contents of the formed bag can be dropped down through a filling tube into the tubularly formed bag.

As the film is fed forwardly to the form, fill and seal machine, a fastener strip assembly 16 is attached to the inner surface of the film. That is, it is attached to the surface which will be on the inside of the bag when the bag is formed into a tube. The fastener strip may be laid directly on the film, but preferably is fed laterally across the upper surface of the film at right angles to the longitudinal edges of the film, o in other words at right angles to the longitudinal formation axis of the film.

The fastener strip is provided from a supply roll 15 fed through a guide 14 and into a channel 13. Suitable means are provided for cutting off a length of fastener strip from the film and the length of the strip 16 will be substantially equal to one-half of the film width.

Figure 2:
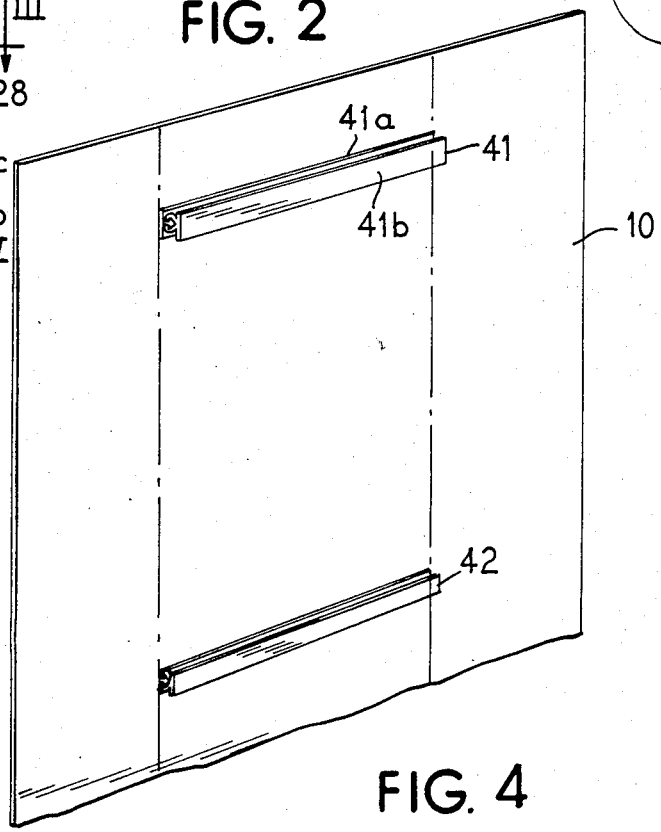
FIG. 2 is an enlarged perspective view of a portion of the film with fastener strips attached prior to being formed into a bag.

The fastener strip will include two profile strips which are interlocked. As shown, one profile strip contains a groove and the other, an arowhead shaped profile which is lockingly receive in the groove and the rib and groove profile strips are interlocked or joined before they are fed across the film. The guide mechanism shown generally at 12 includes a channel 13 which positions the strip assembly 16. The strip is secured or attached to the film so that only the lower portion of the profiles is secured to the film. The first portion 41*a*, FIG. 2, is bonded to the surface of the film such as by applying heat from outside of the surface of the film. The first strip 41*a* may be fully bonded or only tacked to the film, but as such will support the second profile strip 41*b* which is interlocked thereto. The strips are attached at midpoint of the edges of the film 10 and the lateral portions of the film beyond the ends of the strips 41 are sufficiently long so that they can be folded over the top of the strips 41.

The film has fastener strips attached to the upper surface, extending laterally, at spaced intervals as shown by the strips 17, 18, 18*a*, 19, 20, 26 and 30.

The film is fed downwardly over shaping shoulders 21 to guide the film over a vertical forming and filling tube 24. The edges of the film are brought together and are pressed together by rollers 25 to form a flange seam. The seam is welded by heated welding bars 22 and 23 which are brought together against opposite sides of the fin seam 37. Contents are then dropped through the tube 24 into the tubular formed bag which has a lower seam 29.

Figure 3:
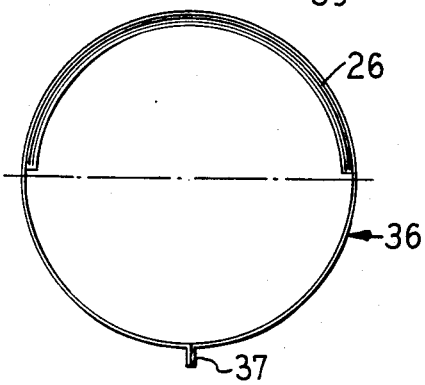
FIG. 3 is a sectional view taken substantially along line III—III of FIG. 1.
Figure 4:
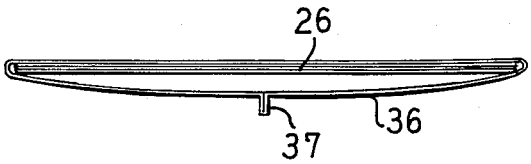
FIG. 4 is a sectional view taken substantially along line IV—IV of FIG. 1.

As the film is formed into tubula shape, the fastener strips, which are shown at 26 in FIG. 3, slide over the vertical form fill tube 24. The tube has the appearance of FIG. 3 and as it moves downwarly, it is flattened so it has the appearance shown in FIG. 4. As will be noted at this point, with the film in the tubular condition shown in FIG. 3 and in the flattened condition of FIG. 4, only the first profile strip is secured to the inner surface of one side wall of the bag.

When the contents are in the tube, having been dropped downwardly through the filling tube 24, the top of the bag is completed. This completion involves a number of operations which are performed simultaneously by sealing and cutting bars 27 and 28 which are moved against the outer surfaces of the tubula film by mechanism, not shown.

The bars 27 and 28 secure the profile strips to the inner surface of the bag. The bar 27 has a heated sealing bar 32, and the bar 28 has a heated sealing bar 31. These move against the profile strips applying heat to the outer surface of the film causing the film to be heat sealed to both strips. While the film has already been sealed to one of the strips at the station 12, it may be that the strip at this point was only tacked to the film so that a full heat seal is accomplished by the bar 31. The second strip 41*b* has been free of attachment to the opposing bag wall, but at the location shown, th bar 32 moves against the film and causes it to be heat welded to the second fastener strip 41*b*.

Figure 5:
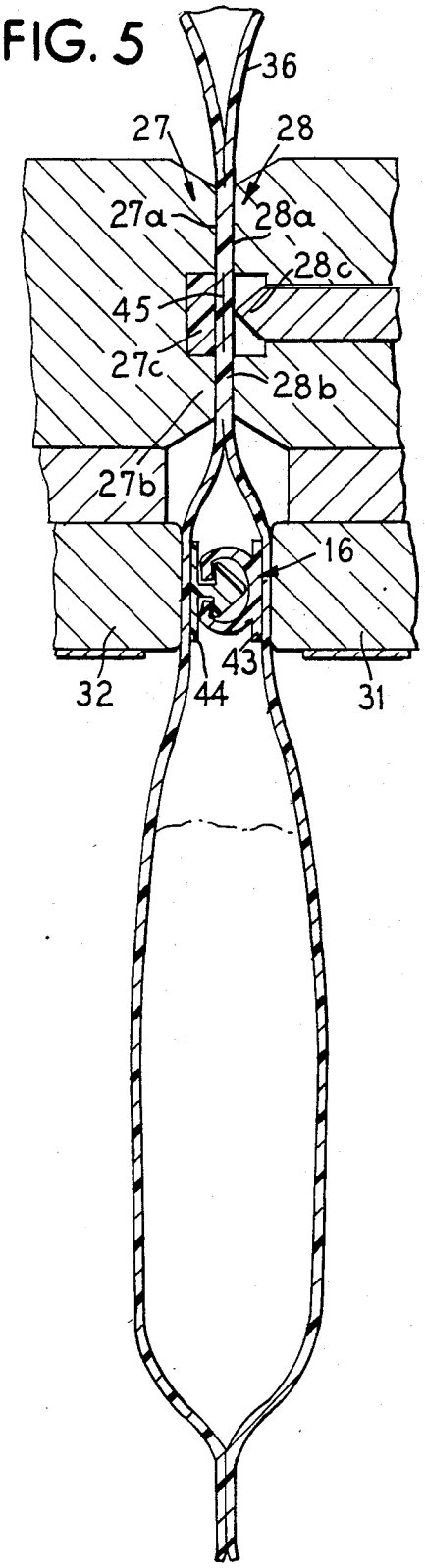
FIG. 5 is a sectional view taken substantially along lnne V—V of FIG. 1.

FIG. 5 shows this in detail wherein the bar 31 which is heated engages the film outside of a base 43 of the profile strip 16. Heated bar 32 engages the film outside of a base 44 of the other fastener strip so that each of the strips are heat welded to the film.

Above the interlocked fastener strip 16, FIG. 5, the opposing bars 27 and 28 seal both the top of the prefilled package and the bottom of the next succeeding package. The bars 27 and 28 have a heated portion 27*a* and 28*a* which form a seam for the bottom of the next succeeding bag. Raised portions 27*b* and 28*b* of the bars 27 and 28 join the layers of film to form a seam above the fastener strip 16. This seam is a pilfer-evident closure for the bag and the seam can be removed cut off the top of the bag before the bag is to be used.

Located in the center of the bars 27 and 28 is a knife 28*c* which cuts the plastic film at 45 with the knife pressing against an anvil 28*c*. This separates the lower filled bag from the formed tube above permitting it to drop down as shown in FIG. 1 wherein a cross-seam 33 is formed at the bottom of a bag, a fastener 34 is at the top of the bag, and a pilfer-vvident seal 35 is above the fastener.

Figure 6:
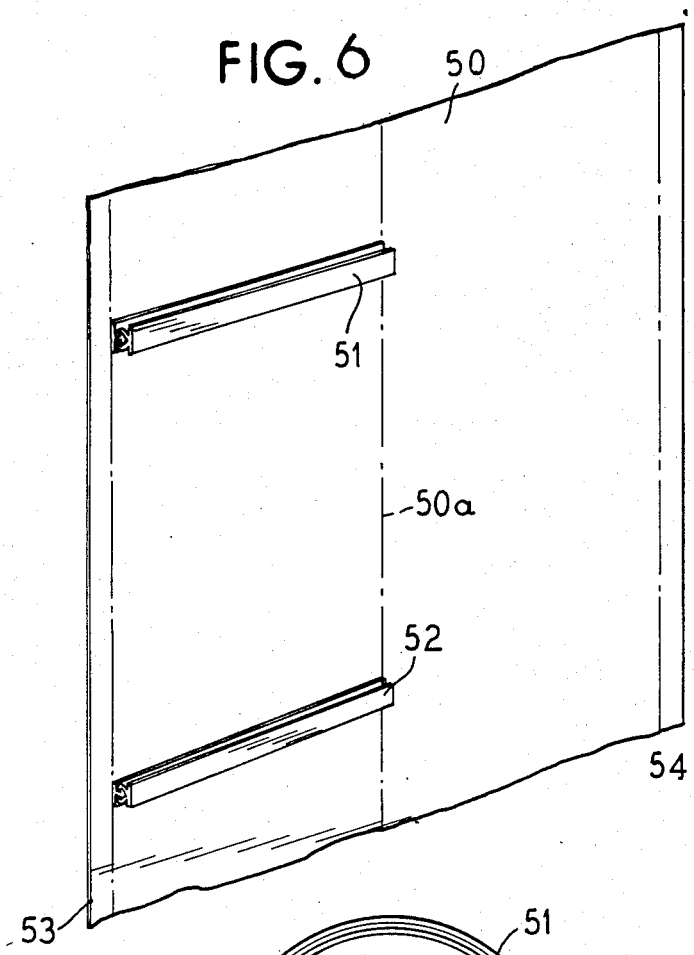
FIG. 6 is an enlarged perspective view, similar to FIG. 2, but illustrating another manner in which the fastener trips can be attached.
Figure 7:
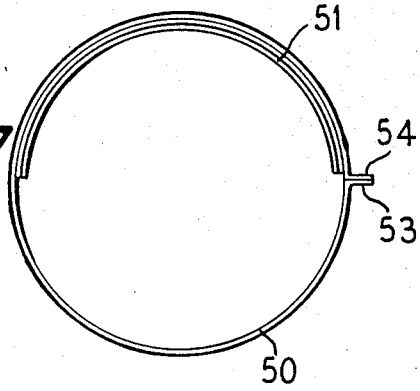
FIG. 7 is a sectional view similar to FIG. 3 illustrating the position of the fastener strips when they are attached in accordance with the illustration of FIG. 6.
Figure 8:
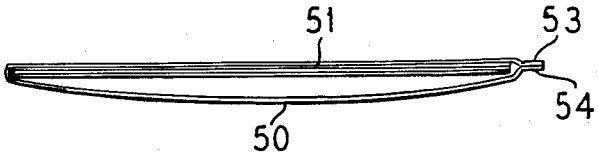
FIG. 8 is a sectional view similar to FIG. 4 but illustrating the fastener strips when attached as illustrated in FIG. 6.

FIGS. 5 through 8 illustrate a modified way of attaching the assembled strips. In this arrangement, the strips are also of a length equal to approximately one-half the width of the film, but are located at one side of the film rather than the center. As shown in FIG. 6, the film 50 has strips 51 and 52 secured to the surface of the film laterally of the longitudinal formation axis 50*a* of the film. At the edges 53 and 54 of the film, these edges will be brought together to form a seam as shown in FIGS. 7 and 8. The assembled fastener strips will lie along one inner wall of the tube as shown in FIG. 7 when the film is tubular shaped and continue to lie along one wall when the film tube is flattened as shown in FIG. 8. nn the arrangement of FIGS. 6 through 8, the fin seam 53, 54 will be present at the side of the bag rather than along the center of one face as it is in the arrangement of FIGS. 2 through 4.

In operation as illustrated in FIG. 1, a length of film 10 is moved forward incrementally and at spaced intervals, assembled fastener strips such as 16 and 17 are secured to the upper surface of the film with only one of the interlocked strips joined to the surface of the film.

The film is then pulled forward and formed into tubular shape over a form fill tube 24 and the edges of the film are joined in a seam 37. The fastener strip lies along one inner wall of the tube, out of the way when contents are dropped into the bag through the form fill tube 24.

Bars 27 and 28 are brought laterally against the tube clamping it, and these bars are moved downwardly to pull a fresh length of film down over the tube 24. The bars also function to apply heat to the outer surface of the film and thereby join the second profile strip of the film to the opposite wall of the bag. The bars also have spaced heating faces to form cross-seams across the film with the lower seam providing a pilfer-evident closure at the top of the bag and the upper seam forming a bottom seam for the next succeeding bag. A knife 28c carried by the bars severs the film between the cross-seals so as to cut off and drop a filled bag, and this operation is shown in greater detail in FIG. 5.

Thus, it will be seen that there has been provided an improved mechanism for form, fill and seal equipment, attaching assembled fastener strips in a unique manner by preattaching them to the film in advance of the formation of the film into a tube. The preassembled fastener strips slide past the tube during the filling operation and attachment of the strips to the other wall of the bag is completed after the bag has been filled. This arrangement substantially speeds up operation, insuring a secure attachment of the film to the fastener and completing the bag in a single rapid process.

We claim as our invention:

1. In a form fill process of making bags with reclosable fasteners comprising the steps:

supplying a continuous film of plastic bag material;

positioning a fastener having first and second interlocked fastener profile strips on the surface of the film;

securing one of said strips to the film surface at a location corresponding to the reclosable opening of a bag formed from the film with the strip secured to the inner surface of one of the bag walls;

forming the bag; and thereafter securing the other of said strips to the inner surface of the formed bag so that the strips will be on opposing bag surfaces at the bag opening.

2. In a form fill process of making bags with reclosable fasteners in accordance with the steps of claim 1:

wherein the fastener is positioned laterally of the length of the continuous film of plastic bag material and laterally of the forming axis of the bag.

3. In a form fill process of making bags with reclosable fasteners in accordance with the steps of claim 1:

wherein the bag is seamed after it is formed.

4. In a form fill process of making bags with reclosable fasteners in accordance with the steps of claim 1:

wherein the strips are secured adjacent the top end of the bag.

5. In a form fill process of making bags with reclosable fasteners in accordance with the steps of claim 1:

wherein the fastener is positioned by moving laterally across the axis of the film of plastic bag material.

6. In a form fill process of making bags with reclosable fasteners in accordance with the steps of claim 1:

wherein each of said strips are heat seamed to the bag material by the application of heat to the film.

7. In a form fill process of making bags with reclosable fasteners in accordance with the steps of claim 1:

wherein the bag is formed by drawing the film downwardly over a tube to join the longitudinal edges of the film.

8. In a form fill process of making bags with reclosable fasteners in accordance with the steps of claim 1:

wherein the longitudinal edges are joined in a side seam prior to the securing of said other strip.

9. In a form fill process of making bags with reclosable fasteners in accordance with the steps of claim 1:

wherein said fastener is of a length substantially equal to one-half of the width of the continuous film of plastic bag material.

10. In a form fill process of making bags with reclosable fasteners in accordance with the steps of claim 9:

wherein the fastener is positioned at the center of the film midway between the longitudinal edges thereof.

11. In a form fill process of making bags with reclosable fasteners in accordance with the steps of claim 9:

wherein the fastener is positioned at one side of the continuous film of plastic bag material.

12. In a form fill process of making bags with reclosable fasteners in accordance with the steps of claim 1:

wherein the fastener is adhered to the film at a location corresponding with the top of the bag and wherein the film is cross-seamed laterally of a formation axis of the bag above the fastener to form a bottom for a succeeding bag.

13. In form fill process of making bags with reclosable fasteners in accordance with the steps of claim 12:

including subsequently cutting the film laterally of the formation axis between the cross-seam and the fastener.

14. In a form fill process of making bags with reclosable fasteners in accordance with the steps of claim 1:

including the step of first assembling and interlocking the fastener profiles before positioning them on the film.

15. In a form fill process of making bags with reclosable fasteners in accordance with the steps of claim 1:

including supplying the fastener from a strip wound on a continuous roll and severing a length of the fastener to be applied to the film.

16. The method of making bags in a form fill process comprising the steps:

supplying a continuous film of plastic bag material and moving said film forward in a bag forming direction parallel to the formation axis of a bag to be formed from the film;

moving a fastener laterally across the film with the fastener having first and second interlocked fastener profile strips;

securing one of said strips to the film surface at a location corresponding to the top of the bag to be formed from the film;

drawing the film forwardly bringing the longitudinal edges together and sealing the edges to form the bag;

securing the other fastener profile strip to the inner surface of the bag wall;

cross-seaming the walls of the material to each other above the fastener strip to form the bottom end of a succeeding bag; and cutting the film between the seam and strip to remove a completed bag from the film.

17. A mechanism for making reclosable bags comprising in combination:

means for supplying a continuous film of plastic bag material;

means positioning a fastener having first and second interlocked fastener profile strips on the surface of the film leaving a portion of the film to be laid over the fastener;

means securing the first of the strips to the film surface;

means forming the film into a bag with the strips on the inner surface of the one of the bag walls; and means securing the second strip to the inner surface of the opposing bag wall.

18. A mechanism for making reclosable bag constructed in accordance with claim 17:

including means for positioning the fastener laterally across the film at right angles to the longitudinal formation axis of the film.

19. A mechanism for making reclosable bags constructed in accordance with claim 17:

wherein said positioning means moves the fastener laterally across the film at right angles to the longitudinal forming axis of the film.

20. A mechanism for making reclosable bags constructed in accordance with claim 17:

wherein said positioning means locates the fastener at a place which will be the eventual bag top.

21. A mechanism for making reclosable bags constructed in accordance with claim 17:

including heat seal means positioned for applying heat to the outer surface of the film for attaching the first and second strips to the film.

22. A mechanism for making reclosable bags constructed in accordance with claim 17:

including means for folding the film bringing the lateral edges together joining said edges prior to securing the second strip to the inner surface of the bag wall.

23. A mechanism for making reclosable bags constructed in accordance with claim 17:

wherein said securing means attaches the first strip to the film surface at the center thereof intermediate th sides of the film.

24. A mechanism for making reclosable bags constructed in accordance with claim 17:

wherein said securing means locates the strip laterally onto the film extending inwardly from one edge thereof.

25. A supply of plastic film material for forming a bag comprising:

a continuous film strip for forming a series of plastic bags; and a plurality of fasteners on the surface of the strip at locations extending laterally of the longitudinal forming axis of the strip and having first and second interlocked profile strips with the first strip secured to the film surface and extending only a portion of the way across the film so that the remainder of the film can be folded over the strip to attach the second profile strip to the film after the bag is formed.

26. A supply of plastic film material for forming a bag constructed in accordance with claim 25:

wherein the fastener strip is substantially one-half the width of the film and is located centrally of the edges thereof.

27. As supply of plastic film material for forming a bag constructed in accordance with claim 26:

wherein the fastener strip is substantially one-half the width of the film and is located extending inwardly from one side of the film.

28. A supply of plastic film material for forming a bag constructed in accordance with claim 25:

wherein the film is folded so as to bring the longitudinal side edges together and said edges are seamed to each other.

29. A supply of plastic film material for forming a bag constructed in accordance with claim 25:

wherein the film is folded to bring its side edges together and the edges are joined and a cross bottom seam is formed joining the inner surfaces of the walls of a bag above the location of the fastener strip so as to form the bottom of the next succeeding bag.

* * * * *

US004909017B1

REEXAMINATION CERTIFICATE (3721th)

United States Patent [19] [11] B1 4,909,017

McMahon et al. [45] Certificate Issued Feb. 9, 1999

[54] RECLOSABLE BAG MATERIAL, METHOD AND APPARATUS

[75] Inventors: Michael J. McMahon, Palatine; Paul P. Spanier, Arlington Heights, both of Ill.

[73] Assignee: Minigrip, Inc., Orangeburg, N.Y.

Reexamination Request:
No. 90/004,959, Apr. 7, 1998

Reexamination Certificate for:

| | |
|---|---|
| Patent No.: | **4,909,017** |
| Issued: | **Mar. 20, 1990** |
| Appl. No.: | **386,348** |
| Filed: | **Jul. 28, 1989** |

[51] Int. Cl.[6] ..... B65B 61/18; A44B 19/00; B31B 1/90; B65D 33/24

[52] U.S. Cl. ..... 53/410; 53/133.4; 53/139.2; 53/412; 53/451; 53/551; 156/66; 383/63; 428/223; 493/213

[58] Field of Search ..... 53/133.4, 410, 53/412, 450, 451, 550, 551, 552, 139.2; 156/66; 383/63; 428/223; 493/213, 214

[56] References Cited

U.S. PATENT DOCUMENTS

| | | |
|---|---|---|
| 3,381,592 | 5/1968 | Ravel . |
| 4,240,241 | 12/1980 | Sanborn, Jr. . |
| 4,246,288 | 1/1981 | Sanborn, Jr. . |
| 4,335,817 | 6/1982 | Bahr . |
| 4,355,494 | 10/1982 | Tilman . |
| 4,437,293 | 3/1984 | Sanborn, Jr. . |
| 4,601,694 | 7/1986 | Ausnit . |
| 4,617,683 | 10/1986 | Christoff . |
| 4,655,862 | 4/1987 | Christoff et al. . |
| 4,663,915 | 5/1987 | Van Erden et al. . |
| 4,666,536 | 5/1987 | Van Erden et al. . |
| 4,709,398 | 11/1987 | Ausnit . |
| 4,709,533 | 12/1987 | Ausnit . |
| 4,790,126 | 12/1988 | Boeckmann . |
| 4,840,611 | 6/1989 | Van Erden et al. . |
| 4,896,775 | 1/1990 | Boeckmann et al. . |

FOREIGN PATENT DOCUMENTS

| | | |
|---|---|---|
| 61-232110 | 10/1986 | Japan . |
| 61-232111 | 10/1986 | Japan . |
| 62-135160 | 6/1987 | Japan . |

*Primary Examiner*—Daniel B. Moon

[57] ABSTRACT

A new method of makine a form fill bag having a reclosable fastener thereon and a mechanism therefor wherein a continuous length of film is advanced and joined first and second fastener profile strips are laid laterally onto the film of a length substantially equal to one-half of the film width, the film is advanced and formed into a tube with the side edges folded together and seamed, the first profile strip is attached to the surface of the film prior to forming it into the tube and the second opposed interlocked profile strip is attached to the inner surface of the film after it is formed into a tube, and a cross-seam is formed in the tube above the closure strip to form the bottom of the succeeding bag and a completed bag is cut from the film by cutting below the bottom seam and above the fastener strips.

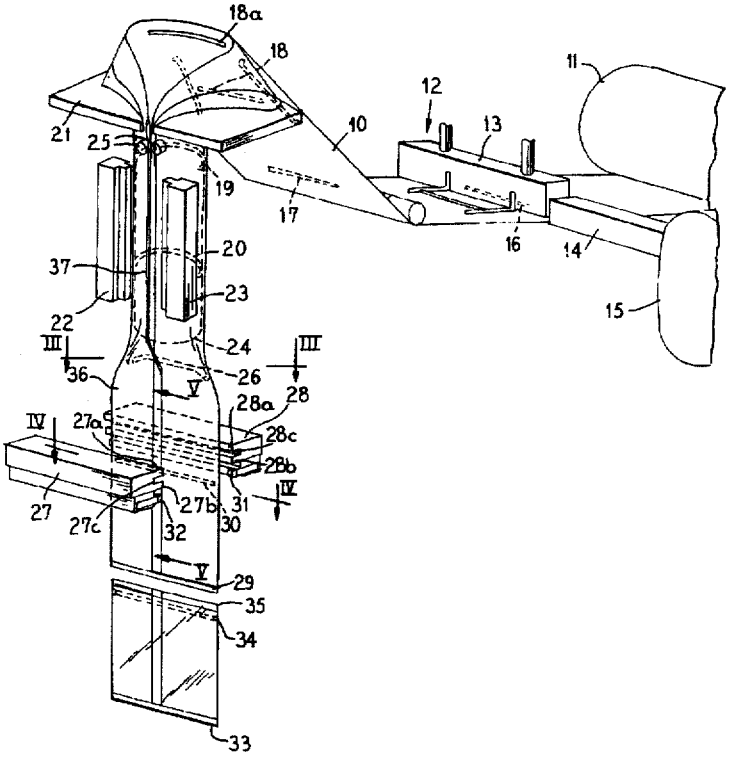

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 16, 17 and 25 are determined to be patentable as amended.

Claims 2–15, 18–24 and 26–29, dependent on an amended claim, are determined to be patentable.

New claims 30–38 are added and determined to be patentable.

1. In a form fill process of making bags with reclosable fasteners comprising the steps:

supplying a continuous film of plastic bag material;

positioning a fastener having first and second interlocked fastener profile strips on the surface of the film;

*initially* securing one of said strips to the film surface at a location corresponding to the reclosable opening of a bag formed from the film with the strip *initially* secured to the inner surface of one of the bag walls;

forming the bag; and thereafter *finally* securing [the other] *both* of said strips to the inner [surface] *surfaces* of the formed bag so that the strips will be *finally secured* on opposing bag surfaces at the bag opening.

16. The method of making bags in a form fill process comprising the steps:

supplying a continuous film of plastic bag material and moving said film forward in a bag forming direction parallel to the formation axis of a bag to be formed from the film;

moving a fastener laterally across the film with the fastener having first and second interlocked fastener profile strips;

*initially* securing one of said strips to the film surface at a location corresponding to the top of the bag to be formed from the film;

drawing the film forwardly bringing the longitudinal edges together and sealing the edges to form the bag;

*finally* securing [the other] *both of said* fastener profile [strip] *strips* to the inner [surface] *surfaces* of the bag [wall] *walls*;

cross-seaming the walls of the material to each other above the fastener strip to form the bottom end od a succeeding bag; and cutting the film between the seam and strip to remove a completed bag from the film.

17. A mechanism for making reclosable bags comprising in combination:

means for supplying a continuous film of plastic bag material;

means positioning a fastener having first and second interlocked fastener profile strips on the surface of the film leaving a portion of the film to be laid over the fastener;

means *initially* securing the first of the strip to the film surface;

means forming the film into a bag with the strips on the inner surface of the one of the bag walls; and means *finally* securing [the second strip] *both of said strips* to the inner [surface] *surfaces* of [the] opposing bag [wall] *walls*.

25. A supply of plastic film material for forming a bag comprising:

a continuous film strip for forming a series of plastic bags; and a plurality of fasteners on the surface of the strip at locations extending laterally of the longitudinal forming axis of the strip and having first and second interlocked profile strips with the first strip [secured] *tacked* to the film surface and extending only a portion of the way across the film so that the remainder of the film can be folded over the strip to *fully* attach the *first and* second profile [strip] *strips* to the film after the bag is formed.

*30. In a form fill process of making bags with reclosable fasteners in accordance with the steps of claim 1:*

*wherein said initial securing of said one of said strips is by tacking said strip to the film surfaces.*

*31. A method of making bags in a form fill process in accordance with the steps of claim 16:*

*wherein said initial securing of said one of said strips is by tacking said strip to the film surface.*

*32. A mechanism for making reclosable bags constructed in accordance with claim 17:*

*wherein said initial securing means tacks the first of the strips to the film surface.*

*33. A vertical form fill process of making bags with reclosable fasteners comprising the steps:*

*supplying a continuous length of plastic film, said length of film having a longitudinal axis and a horizontal film surface;*

*horizontally advancing said film in a direction parallel to said longitudinal axis;*

*supplying a length of fastener having first and second interlocked fastener profile strips from a continuous supply thereof located laterally of said film, each of said fastener profile strips including a base;*

*positioning the fastener length on the horizontal film surface of said film transverse to said longitudinal axis;*

*securing the fastener length to the horizontal film surface of the horizontally advancing film by initially heat sealing the base of only said first fastener profile strip to the film surface at a location corresponding to the reclosable opening of a bag to be formed from the film with this strip secured to the inner surface of one of the bag walls;*

*changing the direction of the film from the horizontally advancing direction to a vertical direction;*

*forming the bag in said vertical direction, said bag having opposing vertically advancing walls; and*

*securing both said first and second fastener profile strips to opposing inner surfaces of said vertically advancing bag walls by finally heat sealing the bases of said first and second fastener profile strips to said opposing inner surfaces so that the fastener profile strips will be on opposing bag wall inner surfaces at the bag opening;*

*whereby a reclosable fastener is provided at the top of the bags in a way that high speed operation can be*

*achieved and the attachment of the fastener does not impede the speed and facility of making the bags.*

*34. A vertical form fill process of making bags with reclosable fasteners in accordance with claim 33 wherein:*

*said first fastener profile strip is initially tacked to said horizontally advancing film.*

*35. A method of making bags in a vertical form fill process comprising the steps:*

*supplying a continuous length of plastic film having a longitudinal axis and a horizontal film surface and horizontally advancing said film forwardly in a bag forming direction parallel to said longitudinal axis;*

*supplying a fastener having first and second interlocked fastener profile strips from a continuous supply thereof located laterally of said film, each of said fastener profile strips including a base;*

*moving said fastener laterally across the horizontal film transverse to said longitudinal axis;*

*securing a length of said fastener to said horizontally advancing film by initially heat sealing the base of only said first fastener profile strip to the horizontal film surface at a location corresponding to the top of the bag to be formed from the film;*

*drawing the film with the secured fastener forwardly in a horizontal direction and thereafter bringing the longitudinal edges together in a vertical direction and sealing the edges to form a bag having opposing bag walls;*

*securing both said first and second fastener profile strips to opposing inner surfaces of said bag walls by finally heat sealing the bases of said fastener profile strips to said opposing inner surfaces;*

*cross-seaming the bag walls to each other above the fastener strip to form the bottom end of a succeeding bag; and*

*cutting the film between the seam and strip to remove a completed bag from the film;*

*whereby a reclosable fastener is provided at the top of the bags in a way that high speed operation can be achieved and the attachment of the fastener does not impede the speed and facility of making the bags.*

*36. A method of making bags in a vertical form fill process according to claim 35 wherein:*

*said first fastener profile strip is initially tacked to the horizontally advancing film.*

*37. A vertical form fill mechanism for making reclosable bags comprising in combination:*

*means for supplying a continuous length of plastic film having a longitudinal axis and a horizontal surface, said continuous length of film being horizontally advanced in a direction parallel to said longitudinal axis:*

*means for supplying a fastener having first and second interlocked profile strips from a continuous supply thereof located laterally of the horizontal film, each of said fastener profile strips including a base;*

*means for positioning the fastener on the horizontal surface of the horizontal film, said fastener being positioned transverse to the longitudinal axis leaving a portion of the film to be laid over the fastener;*

*first securing means for securing the fastener to the horizontally advancing film by initially heat sealing the base of only said first fastener profile strip to the horizontal surface;*

*means for forming the film into a bag along a vertical axis with the strips on the inner surface of a first of two opposing bag walls; and*

*second securing means for securing both said first and second fastener profile strips to said opposing bag walls by finally heat sealing the bases of said fastener profile strips to the inner surfaces of said opposing bag walls;*

*whereby a fastener is provided at the top of the bags in a way that high speed operation can be achieved and the attachment of the fastener does not impede the speed and facility of making the bags.*

*38. A vertical form fill mechanism for making reclosable bags according to claim 37 wherein:*

*said first securing means initially tacks said first fastener profile strip to the horizontal surface of the horizontally advancing film.*

* * * * *